US006732879B2

(12) United States Patent
Hamann

(10) Patent No.: US 6,732,879 B2
(45) Date of Patent: May 11, 2004

(54) ARTICLE OF MANUFACTURE FOR THE HANGING OF SCREW TOP BOTTLES AND TUBES

(76) Inventor: David Hamann, 4248 Kirby Ave., Cincinnati, OH (US) 45223

( * ) Notice: Subject to any disclaimer, the term of this patent is extended or adjusted under 35 U.S.C. 154(b) by 0 days.

(21) Appl. No.: 10/061,934

(22) Filed: Jan. 31, 2002

(65) Prior Publication Data

US 2002/0113073 A1 Aug. 22, 2002

Related U.S. Application Data

(60) Provisional application No. 60/265,808, filed on Jan. 31, 2001.

(51) Int. Cl.[7] ..... B65D 25/24

(52) U.S. Cl. ..... 220/481; 220/482; 220/751; 206/806

(58) Field of Search ..... 206/806; 220/751, 220/480, 481, 482

(56) References Cited

U.S. PATENT DOCUMENTS 3,119,541 A * 1/1964 Lynn ..... 229/5.5
3,162,339 A * 12/1964 Lecluyse ..... 222/541.9
3,240,384 A * 3/1966 Lermer ..... 220/780
3,304,039 A * 2/1967 Edelman et al. ..... 248/108
3,495,797 A * 2/1970 Ganz ..... 248/339
4,712,671 A * 12/1987 Salacuse ..... 206/736
6,032,797 A * 3/2000 Kao ..... 206/378

* cited by examiner

*Primary Examiner*—Joseph Man-Fu Moy
(74) *Attorney, Agent, or Firm*—Wood, Herron & Evans L.L.P.

(57) ABSTRACT

A device for the hanging of screw-top bottles and tubes such as shampoo bottles and toothpaste tubes on a shower curtain rod, towel rod, storage rack, toothbrush rack or any other bar, rail or line. The device has threads on its bottom or lower section that screw to the top or neck of a shampoo bottle or tube and threads on its top or upper section that screw into the cap of the bottle or tube. The device also contains a hanger that hangs it over a rod or bar. The device allows bottles and tubes to be stored out of the way while still allowing for easy and safe access to the stored bottles and tubes.

22 Claims, 5 Drawing Sheets

SECTION A-A

ARTICLE OF MANUFACTURE FOR THE HANGING OF SCREW TOP BOTTLES AND TUBES

Application for U.S. Letters Patent Utility claiming the benefit of U.S. Provisional Patent Application Ser. No. 60/265,808 filed Jan. 31, 2001.

BACKGROUND OF THE INVENTION

This invention relates generally to shampoo bottles and toothpaste tubes, and more particularly to an article of manufacture for the hanging of any screw bottle or tube.

Currently there are hangers for towels, soap, brushes, radios and other usable products located in the bathroom and other areas of homes, businesses and vehicles. There are also racks for personal care products and other products, commonly found adjacent the sink, bath tub or shower that require the products to stand up or lie down. Ledges and shelves for holding objects are also commonly found adjacent the sink, shower or bath tub. Racks are sometimes inappropriate for use in a particular space and are sometimes unable to fit all of the bottles and tubes that a person needs, or do not contain a provision for holding tubes or bottles. Ledges and shelves adjacent the sink, shower or bath tub often allow the pooling of water and can become unsanitary for holding products.

A number of methods and products have been developed to hold personal care items in the shower or bathroom area-keeping items organized, within easy reach and out of standing water. One very thoughtful method for holding items is by hanging them. For instance, a shampoo bottle may have a hook molded to it, allowing the consumer to hang it on a water pipe, curtain rod, hand rail or storage rack. These products. designed for the hanging storage of bottles and tubes in areas adjacent the sink, bath tub or shower, however, fail to solve the combined problems associated with secure storage and convenient and effective use of the shampoo bottle or toothpaste tube.

An example is the U.S. Pat. No. 5,749,490 issued May 12, 1998 to Roger Myron Keicher for a "DISPENSING BOTTLE HANGER" describing a hanger comprising a thin web of material containing an opening which encircles the bottle's neck. For assembly, the hanger is pushed onto the bottle's neck while the cap is removed and then the cap is replaced. The replaced cap provides a secure fitment of the hanger between the cap and the body of the bottle. The hanger may have advantages if it is designed to fit a specific bottle or if a bottle is specifically designed to accommodate the hanger, however, when considered for use with a variety of existing bottles, its usefulness is reduced. Security of the hanging function is a problem in regard to use with a variety of bottles. If the user wishes to hang the bottle without the cap attached, secure fitment of the hanger to certain bottles is reduced or eliminated. Also, the sealing effect of the cap is a concern when using the hanger with a variety of existing bottles. Since the web material of the hanger requires space to exist between the bottle's cap and body, with certain bottles the cap will be prevented from closing completely and sealing the bottle as intended by the manufacturer.

Another example is U.S. Pat. No. 4,955,572 issued Sep. 11, 1990 to Nowman Simmons for a "SPORTS BOTTLE SUPPORTING DEVICE" describing a hanging device for use with a wide-neck bottle. Although the hanging function differs, the invention is attached to the bottle in the same manner as that of the invention described in U.S. Pat. No. 5,749,490 and has the same deficiencies in usefulness when considered for use with a variety of existing bottles. A further example is U.S. Pat. No. Des. 319,939 for a "COLLAPSIBLE TOOTHPASTE OR SHAMPOO TUBE HOLDER" describing a collapsible tube hanger device. This design patent shows a device that may attach to the end of a tube opposite the cap and causes the tube to be hung in a cap down orientation. When a cap up storage orientation is preferred the design has no usefulness.

These various devices, although useful in their intended application, fall short in the application targeted by the invention herein disclosed and claimed.

The primary object of the invention is to provide an alternative spot for the placement of screw top bottles and screw top tubes.

Another object of the invention is to allow the bottles and tubes to be hung out of the way rather than placed on the side of bathtubs, counters, sinks and showers.

Another object of the invention is to allow the bottles and tubes to be safely stored.

A further object of the invention is to provide a way for the bottles and tubes to be easily obtained for use.

Yet another object of the invention is to provide a cleaner area for using the products in the bottles and tubes.

Still yet another object of the invention is to provide a sanitary place to hang the bottles and tubes.

Yet a further object of the invention is to allow the bottles and tubes to be securely hung without their caps attached.

Still yet a further object of the invention is to allow the bottles and tubes to be used with their caps as intended by their manufacturers.

Other objects and advantages of the present invention will become apparent from the following descriptions, taken in connection with the accompanying drawings, wherein, by way of illustration and example, an embodiment of the present invention is disclosed.

This invention incorporates the usefulness of a hanger and addresses the problems present in racks, ledges and shelves for holding bottles and tubes. This invention eliminates the need for cumbersome racks that are suctioned to the side of a wall or hung from the shower head. The invention also provides a practical means by which a user can attach it to the bottle or tube and conveniently and securely hang it out of the way, creating sanitary storage until the next use. The present invention is an improvement over existing developments in the art, as will be disclosed herein. The invention is a hanger, in the form of a hook, a post or a ring that attaches to bottles and tubes by screwing onto them in an area between their neck and cap. With a hanger attached, these items can be hung conveniently in a number of places within reach. The threaded hanger device attaches to the bottle/tube in the same way that the bottle's cap attaches—by threads. It has a screw thread inside its base and is screwed onto the top of the bottle. This allows the consumer to easily remove the existing cap and replace it with the hanger product. A channel through the threaded hanger allows shampoo to pass through it and exit the invention, just as it would exit the bottle normally. The hanger also has a screw thread on its top, just like the one on the top of the bottle. This thread allows the consumer to screw the bottle's cap onto the attached hanger to seal the bottle and to allow the cap to function the way it is intended. With hanger attached, the bottle works the same as before, only now, it can be hung for storage.

Additionally, the device can be described as an article of manufacture for the hanging of screw top bottles and tubes comprising a way to hang shampoo and other screw top bottles out of the way on the shower curtain rod or any other bar a way to hang toothpaste tubes and other screw top tubes out of the way on the shower curtain rod or any other bar. The device has threads on the bottom that screw to the top of the shampoo bottle or tube. The device also has threads on the top that screw into the cap of the shampoo bottle or tube. The device is screwed onto the top of the bottle or tube and then the cap screws onto the opposite end of the device. The device contains a hanger that hangs over the shower rod or other bar. The device provides a means for the user to hang shampoo bottles, other type of bottles or jars, toothpaste tubes or any other type of tube or bag out of the way. The device provides a means for the user to store the bottles and tubes for easy and safe access.

The invention is also designed for use with a bottle or tube having a screw top cap containing a specialized dispensing element, such as a sliding, twisting or pivoting valve, with dispensing occurring in the same manner as it intended by the original dispensing mechanism design. The hanger can be manufactured in different sizes and may be designed to fit common standard-sized screw top bottles and screw top caps. The invention will be used for hanging items found in the consumer products industry, such as shampoo, toothpaste, cleaners, gels, lotions, soft drinks, etc. The hanger will also be used for hanging products found in the Health Care, Automotive, Hardware, Leisure and other industries.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

With reference now to the drawings, and in particular FIGS. 1–7, the preferred embodiment, incorporating the principles and concepts of the current invention, will be described.

Figure 2:
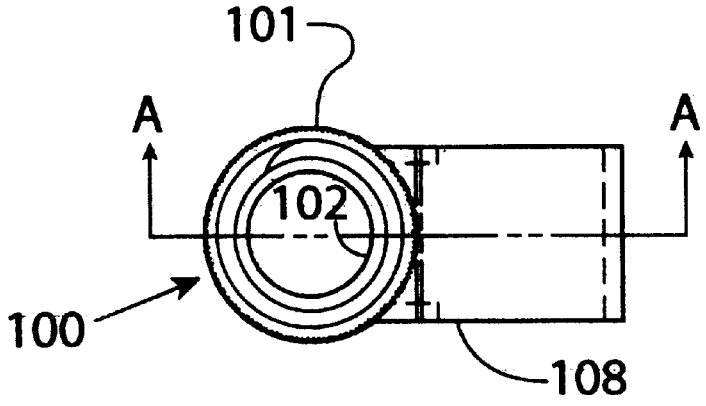
FIG. 2 is a top view orthographic projection of the preferred embodiment of the invention.
Figure 1:
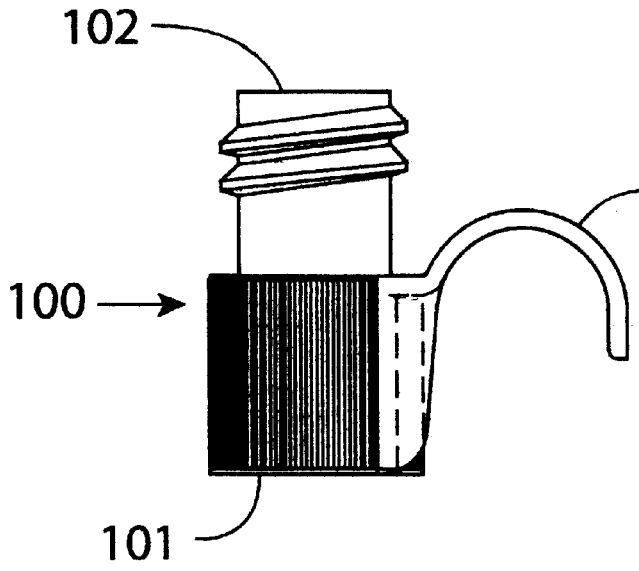
FIG. 1 is a front view orthographic projection of the preferred embodiment of the invention.
Figure 3:
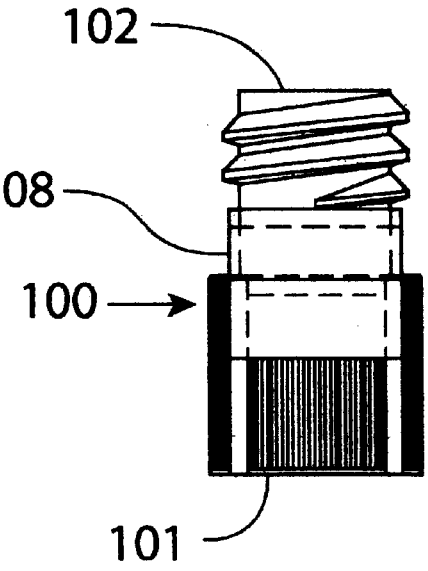
FIG. 3 is a right side view orthographic projection of the preferred embodiment of the invention.

FIGS. 1–3 illustrate the preferred embodiment 100 as a single molded part produced by means of molding or casting from metal or plastic or other substance. The invention could also be produced by an additive means such as fabricating or layering or by a subtractive means such as machining or sculpting or by combinations thereof.

FIGS. 1–3 describe the preferred embodiment 100, having a lower cylindrical element 101, an upper cylindrical element 102 and a hook element 108 which is integral to the body of the invention and extending from the lower cylindrical element 101.

Figure 4:
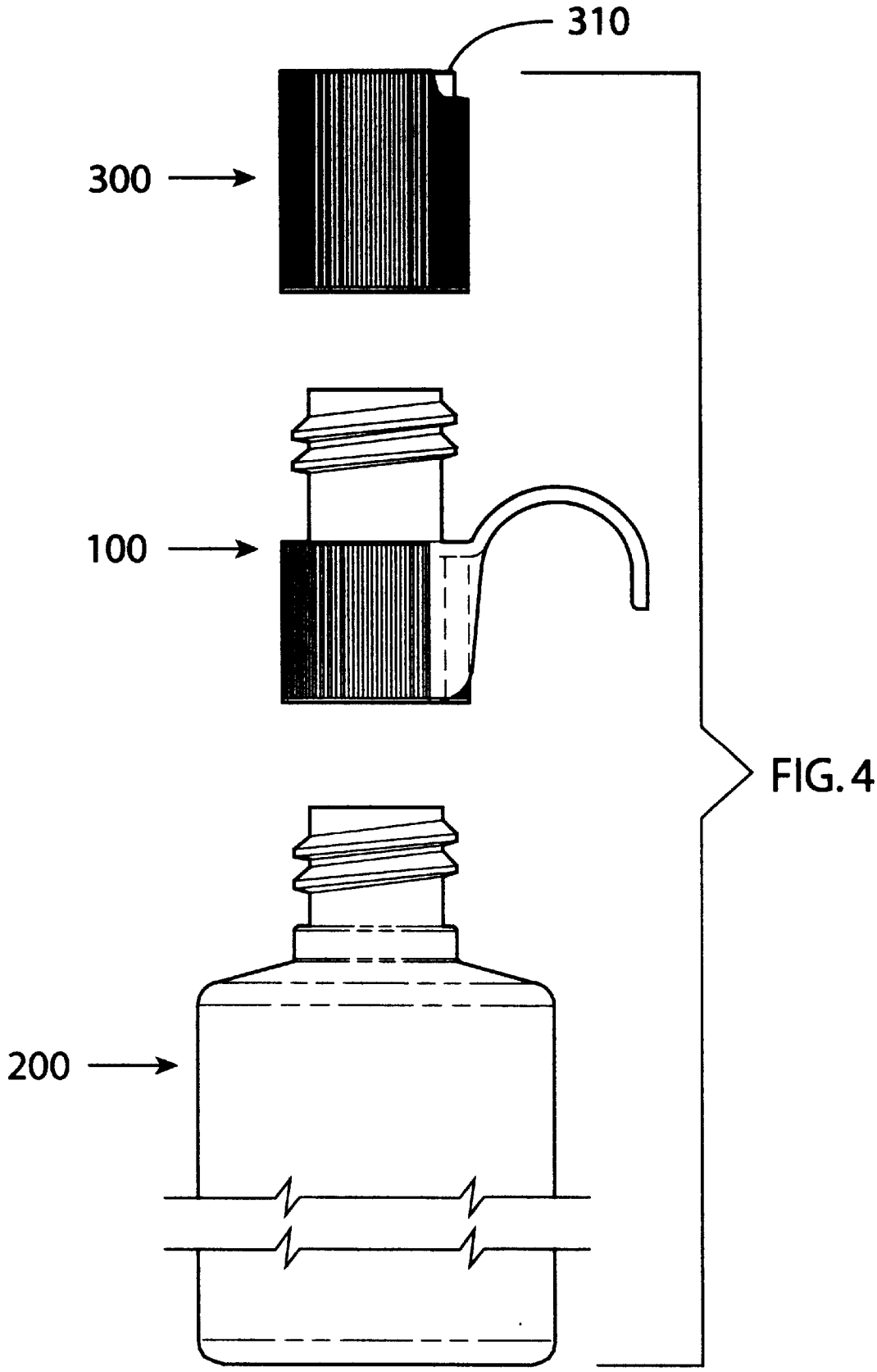
FIG. 4 is an exploded view containing a side view orthographic projection of the preferred embodiment of the invention and of an exemplary screw-top bottle and of an exemplary screw-top bottle cap.

FIG. 4 illustrates the preferred embodiment 100 in an arrangement between a screw-top bottle 200 and a screw-top bottle cap 300. Shampoos, lotions, gels and other personal care fluids are commonly contained in such bottles which are sealed by screw-top caps. Some such caps are designed to be removed by the user to dispense the fluid directly from the bottle's neck opening. Others are designed with a valve mechanism included which can be opened by the user to dispense the fluid from the bottle without removing the cap. The invention is intended for use with either type of cap. The screw-top bottle cap 300 shown, is a valved-type cap, containing a pivoting valve element 310.

Figure 5:
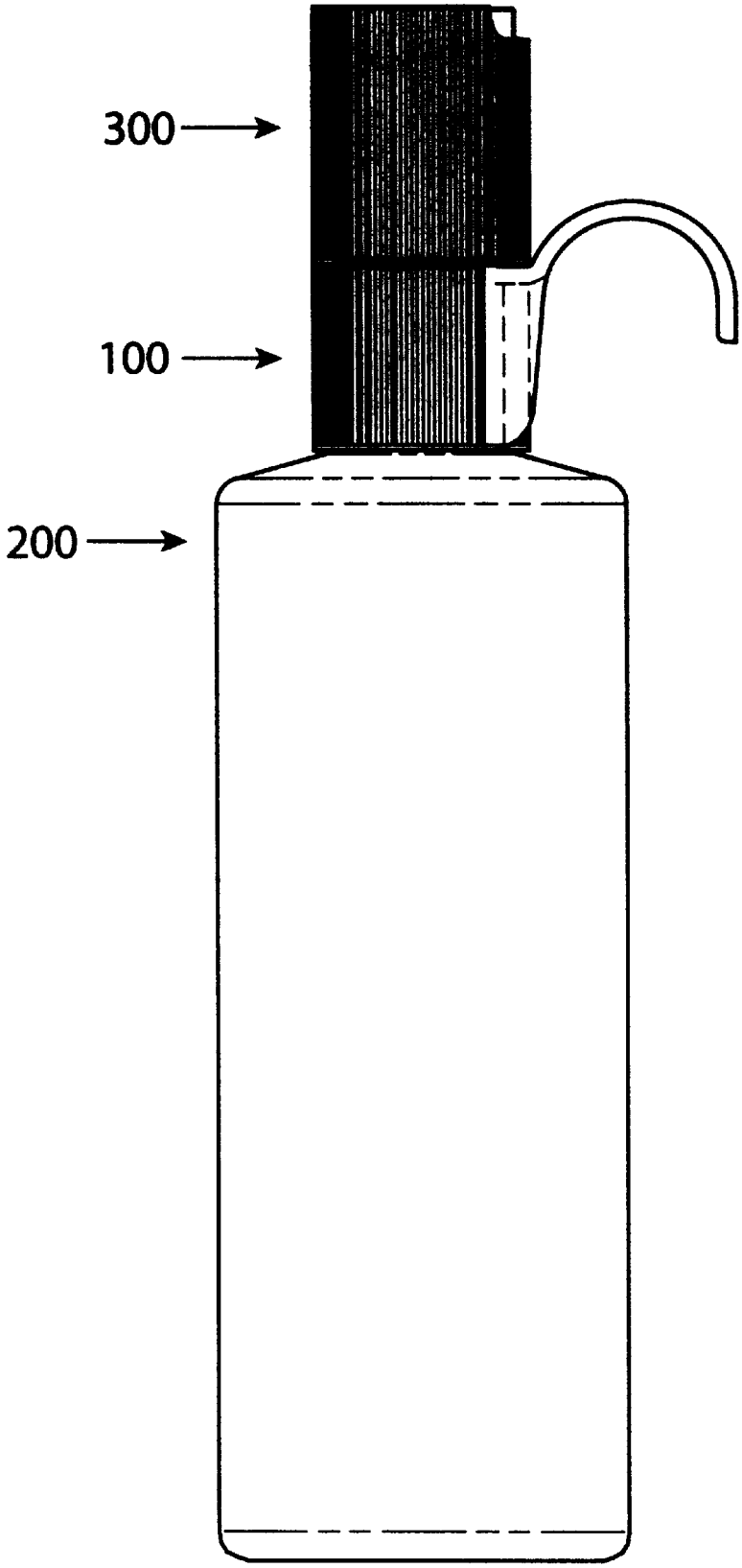
FIG. 5 is an assembled view containing a side view orthographic projection of the preferred embodiment of the invention and an exemplary screw-top bottle and an exemplary screw-top bottle cap.

FIG. 5 illustrates the preferred embodiment 100 coupled, in a sealed connection, with the screw-top bottle 200 and the screw-top bottle cap 300.

Figure 6:
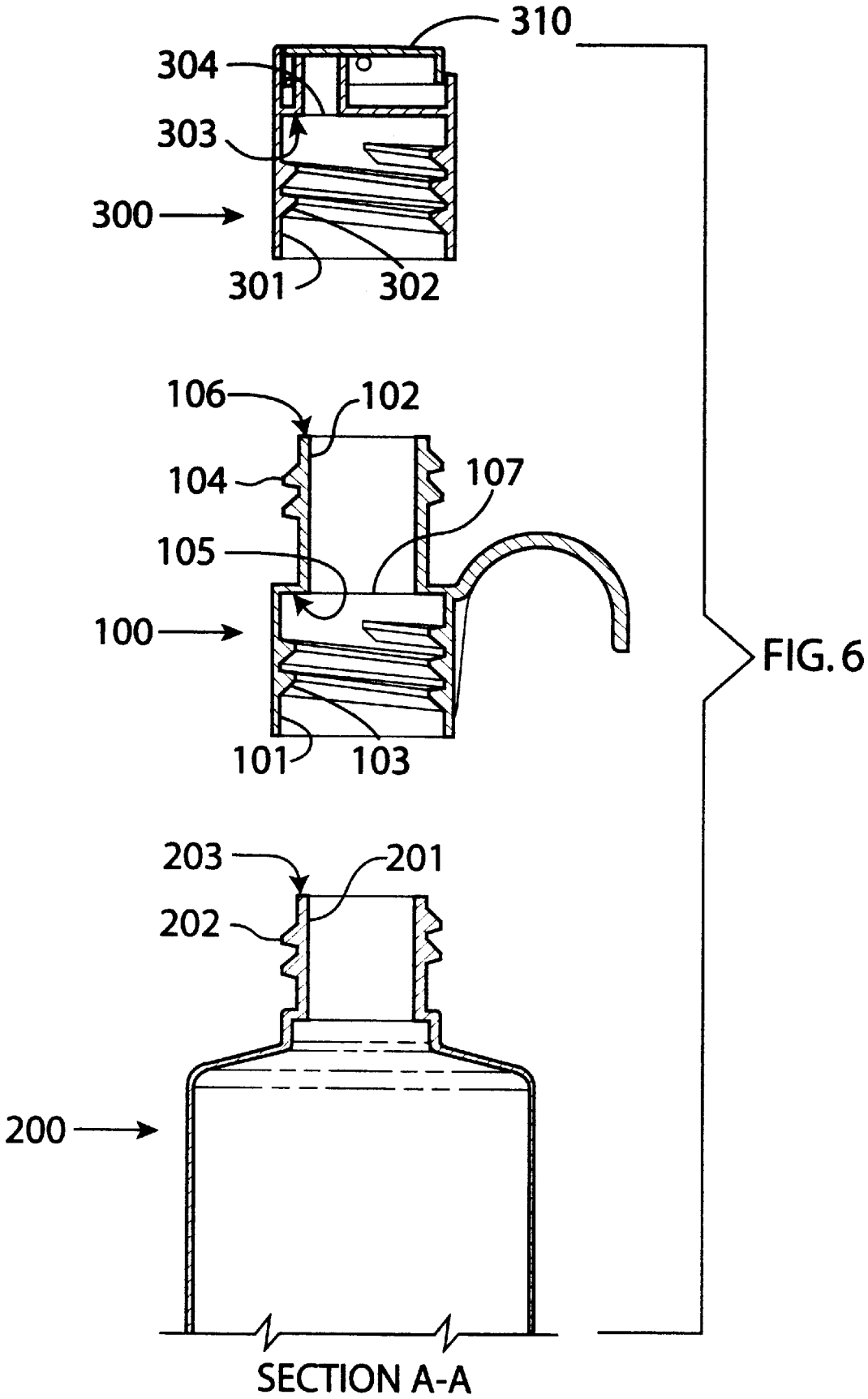
FIG. 6 is an exploded cross-sectional view of the preferred embodiment of the invention and of an exemplary screw-top bottle and of an exemplary screw-top bottle cap.

FIG. 6 illustrates the same arrangement of elements 100, 200 and 300 as in FIG. 4, however, in FIG. 6 the elements are shown in a section view, A—A, identified in FIG. 2. Section view A—A reveals details instrumental in coupling elements 100, 200 and 300 and in forming sealed connections between them.

FIG. 6 contains an illustration of the screw-top bottle 200 with a cylindrical neck 201 having an upper surface 203. From the outer wall of the neck extend bottle threads 202. Also contained is an illustration of the screw-top bottle cap 300 containing a horizontal sealing surface 303 and a cylindrical sleeve 301. From the inner wall of the sleeve extend bottle cap threads 302. The horizontal sealing surface 303 contains an open port hole 304 through which liquid can flow toward the valve mechanism 310. When assembled for normal use, the bottle cap is coupled to the bottle by engagement of the bottle threads 202 with the bottle cap threads 302 and by rotation of the cap 300 until the bottle neck upper surface 203 contacts the bottle cap horizontal sealing surface 303.

FIG. 6 also contains an illustration of the preferred embodiment 100, showing cap threads 103 extending from the inner wall of the lower cylindrical section 101 and neck threads 104 extending from the outer wall of the upper cylindrical section 102. A horizontal sealing surface 105 is also shown. The horizontal sealing surface 105 contains an open port hole 107 through which liquid can flow.

Figure 7:
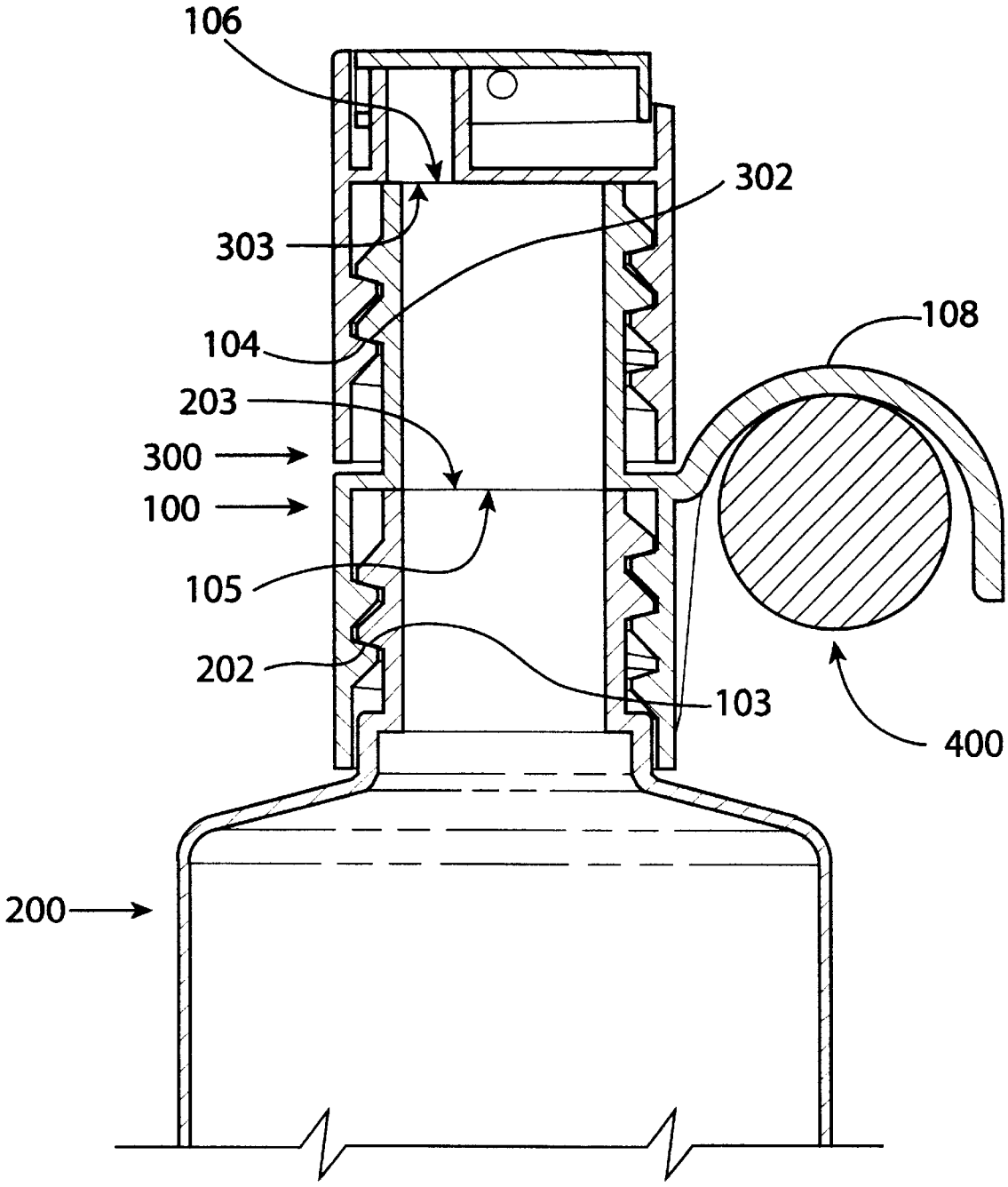
FIG. 7 is an assembled cross-sectional view of the preferred embodiment of the invention and an exemplary screw-top bottle and an exemplary screw-top bottle cap.

FIG.7 illustrates the same arrangement of elements 100, 200 and 300 as in FIG. 5, however, in FIG. 7 the elements are shown in a section view, A—A, identified in FIG. 2. Section view A—A reveals details of the coupled and sealed connection of elements 100, 200 and 300.

FIG. 7. shows the invention's cap threads 103 engaged with the bottle neck threads 202, and the invention's horizontal sealing surface 105 in contact with the bottle neck upper surface 203. Also shown is the invention's neck threads 104 engaged with the bottle cap threads 302, and the invention's cylindrical upper surface 106 in contact with the bottle cap horizontal sealing surface 303. The resulting coupled and sealed arrangement of bottle, invention and bottle cap contains a path through which liquid can flow.

FIG. 7 also shows a cross sectional view of a rod 400. The sectional shape of the rod 400 is shown as round, but could exist in a variety of shapes. The sectional size of the rod 400 could also vary. The hook element 108 of the preferred embodiment 100 is made of a shape and size that allows easy attachment to and detachment from the rod 400 shown.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for hanging a container having a threaded neck and a threaded cap comprising:

a hollow cylinder having an upper section and a lower section, said upper section having an interior wall and an exterior wall, said exterior wall of said upper section having threads, said lower section having an interior wall and an exterior wall, said interior wall of said lower section having threads; and a hanger attached to said cylinder.

2. The device of claim 1 wherein the hanger is a hook.

3. The device of claim 1 wherein the hanger is a post.

4. The device of claim 1 wherein the hanger is a ring.

5. The device of claim 1 wherein said threads of said interior wall of said lower section are adapted to mate with said threaded neck.

6. The device of claim 1 wherein said threads of said exterior wall of said upper section are adapted to mate with said threaded cap.

7. The device of claim 1 further comprising a channel extending through said upper section and said lower section.

8. The device of claim 1 further comprising a generally horizontal ledge connecting said upper section and said lower section, said ledge adapted to seal said cylinder against said threaded neck.

9. A device for hanging a container having a threaded neck and a threaded cap comprising:

a cylinder having an upper cylindrical section and a lower cylindrical section, said upper cylindrical section having an outer wall with neck threads, said neck threads adapted to mate with said threaded cap of said container, said lower cylindrical section having an inner wall with cap threads, said cap threads adapted to mate with said threaded neck of said container;

a channel extending through said upper cylindrical section and said lower cylindrical section; and a hanger attached to said cylinder.

10. The device of claim 9 wherein the hanger is a hook.

11. The device of claim 9 wherein the hanger is a post.

12. The device of claim 9 wherein the hanger is a ring.

13. The device of claim 9 further comprising a generally horizontal sealing surface connecting said upper cylindrical section and said lower cylindrical section, said sealing surface adapted to contactually seal said cylinder against said threaded neck of said container.

14. A hangable container comprising:

a screw-top container having a threaded neck and a threaded cap;

a cylinder having an upper cylindrical section and a lower cylindrical section, said upper cylindrical section having an outer wall with neck threads, said neck threads adapted to mate with said threaded cap of said container, said lower cylindrical section having an inner wall with cap threads, said cap threads adapted to mate with said threaded neck of said container;

a channel extending through said upper cylindrical section and said lower cylindrical section; and a hanger attached to said cylinder.

15. The device of claim 14 wherein said screw-top container is a bottle.

16. The device of claim 14 wherein said screw-top container is a tube.

17. The device of claim 14 wherein said screw-top container is a jar.

18. The device of claim 14 wherein said screw-top container is a bag.

19. The device of claim 14 wherein the hanger is a hook.

20. The device of claim 14 wherein the hanger is a post.

21. The device of claim 14 wherein the hanger is a ring.

22. The device of claim 14 further comprising a generally horizontal sealing ledge connecting said upper cylindrical section and said lower cylindrical section, said sealing ledge adapted to contactually seal said cylinder against said threaded neck of said container.

* * * * *